US011391009B2

(12) United States Patent
Bennani Braouli et al.

(10) Patent No.: US 11,391,009 B2
(45) Date of Patent: Jul. 19, 2022

(54) METHOD OF MANUFACTURING A FACING ELEMENT FOR A REINFORCED SOIL STRUCTURE

(71) Applicant: SOLETANCHE FREYSSINET, Rueil Malmaison (FR)

(72) Inventors: Yassine Bennani Braouli, Croissy S/Seine (FR); Matthieu Aressy, Saint Ouen (FR)

(73) Assignee: SOLETANCHE FREYSSINET, Rueil Malmaison (FR)

( * ) Notice: Subject to any disclaimer, the term of this patent is extended or adjusted under 35 U.S.C. 154(b) by 269 days.

(21) Appl. No.: 16/756,838

(22) PCT Filed: Oct. 15, 2018

(86) PCT No.: PCT/EP2018/078123
§ 371 (c)(1),
(2) Date: Apr. 16, 2020

(87) PCT Pub. No.: WO2019/076837
PCT Pub. Date: Apr. 25, 2019

(65) Prior Publication Data

US 2021/0189680 A1 Jun. 24, 2021

(30) Foreign Application Priority Data

Oct. 18, 2017 (WO) ..... PCT/IB2017/001445

(51) Int. Cl.
*B28B 7/06* (2006.01)
*E02D 29/02* (2006.01)
(Continued)

(52) U.S. Cl.
CPC ..... *E02D 29/0225* (2013.01); *B22C 9/00* (2013.01); *B22C 9/03* (2013.01); *B22C 9/10* (2013.01);
(Continued)

(58) Field of Classification Search
CPC ..... B28B 7/06; B28B 7/306; B28B 7/349
See application file for complete search history.

(56) References Cited

U.S. PATENT DOCUMENTS 5,651,911 A 7/1997 Pennypacker
5,839,555 A 11/1998 Hsieh
(Continued)

FOREIGN PATENT DOCUMENTS

EP 2 372 027 A1 10/2011
EP 1 662 050 B1 1/2014
(Continued)

*Primary Examiner* — James Sanders
(74) *Attorney, Agent, or Firm* — Dentons US LLP

(57) ABSTRACT

A void former is arranged in a mold (30). The void former includes an insert (1) made of flexible material that forms a loop around a core region (15) within the mold. Casting material is added in a fluid state into the mold so as to fill a predefined volume for the facing element, including the core region. After hardening of the casting material, the facing element (10) is removed from the mold, and the void former is removed from the facing element. The facing element comprises an anchoring core formed by the hardened casting material in the core region (15). Removing the void former comprises pulling the insert (1) away from a rear surface of the facing element (10). The flexible material of the at least one insert is deformed around the anchoring core (15) while it is pulled.

15 Claims, 10 Drawing Sheets

(51) Int. Cl.

| | |
|---|---|
| ***B22C 9/03*** | (2006.01) |
| ***B22C 9/10*** | (2006.01) |
| ***B28B 7/30*** | (2006.01) |
| ***B28B 7/34*** | (2006.01) |
| ***B22C 9/00*** | (2006.01) |

(52) U.S. Cl.
CPC ..... *B28B 7/06* (2013.01); *B28B 7/303* (2013.01); *B28B 7/306* (2013.01); *B28B 7/348* (2013.01)

(56) References Cited

U.S. PATENT DOCUMENTS

| | | | |
|---|---|---|---|
| 7,127,859 | B2 | 10/2006 | Domizio |
| 7,491,018 | B2 | 2/2009 | Freitag et al. |
| 10,501,907 | B2 | 12/2019 | Freitag et al. |
| 2015/0125221 | A1 | 5/2015 | Kusuma et al. |

FOREIGN PATENT DOCUMENTS

| | | | |
|---|---|---|---|
| EP | 2 850 251 | B1 | 9/2016 |
| WO | 2017/006043 | A1 | 1/2017 |

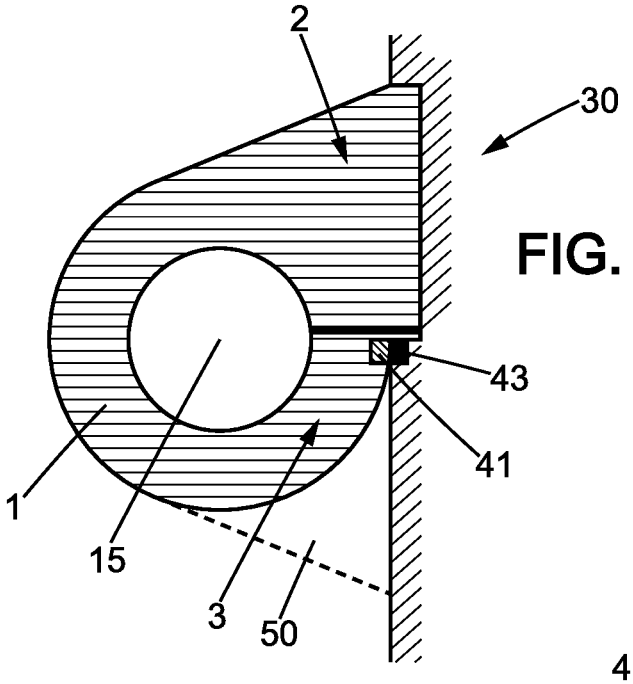
FIG. 4
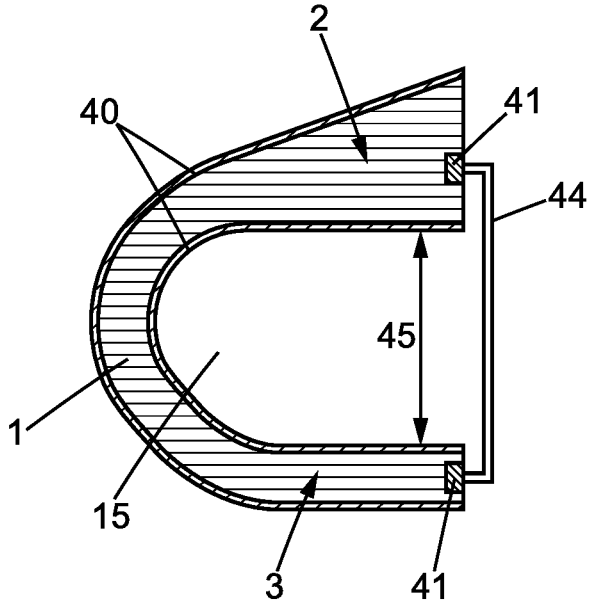
FIG. 5
FIG. 6
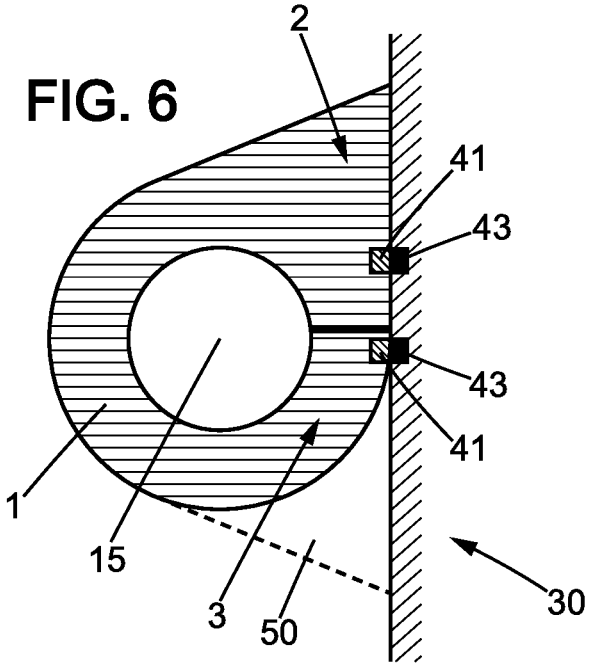

METHOD OF MANUFACTURING A FACING ELEMENT FOR A REINFORCED SOIL STRUCTURE

The present invention relates to the field of manufacturing facing elements for reinforced soil structures.

This application is a National Stage Application of International Application No. PCT/EP2018/078123, filed on Oct. 15, 2018, which claims the benefit of and priority to International Application No. PCT/IB2017/001445, filed on Oct. 18, 2017, all of which are hereby incorporated by reference in their entirety for all purposes as if fully set forth herein.

BACKGROUND

A stabilized soil structure combines a compacted backfill, a facing made of a plurality of facing elements and reinforcements usually connected to the rear side of the facing elements. The reinforcements are placed in the compacted backfill with a density dependent on the stresses that might be exerted on the reinforced soil structure. Thrust forces in the soil are balanced by friction between the reinforcements and the backfill.

The facing elements used in a reinforced soil structure are often in the form of prefabricated concrete panels or blocks, arranged to cover the front face of the structure.

The reinforcements may be in the form of strips placed in the backfill. They are secured to the facing elements by anchoring elements that may take several forms. For example, they can be substantially C-shaped hollow curved portions, or channels, formed in the body of the facing element and surrounding an anchoring core. The reinforcements are then introduced inside the channels of the facing elements to form a loop around the anchoring core.

Once the reinforced soil structure is complete, the reinforcements transmit high loads, in some cases of up to several tons. Their connection to the facing elements needs to be robust in order to maintain cohesion of the structure.

Manufacturing of the anchoring elements in a facing element involves the use of void formers inserted in a mold which gives the facing element its shape. Concrete or some other casting material is poured into the mold to fill a predefined volume excluding the volume occupied by the void formers. This creates the channels forming the anchoring elements once the casting material is hardened.

EP 2 372 027 A1 discusses geometries of channels formed in the rear face of a facing element that improve robustness of the anchoring core to the loads applied by the reinforcement strips.

In EP 1 662 050 B1 and WO 2017/006043 A1, the void formers are hollow plastic sleeves placed in the mold, which remain embedded in the concrete once it has hardened. Such sleeves have an impact on the manufacturing cost of the facing elements since they cannot be retrieved to be used several times. Also, if some casting material accidentally enters the sleeve, the facing element is unusable.

U.S. Pat. Nos. 5,651,911 A and 7,127,859 B2 disclose removable inserts to form channels around steel anchors in the prefabrication of concrete elements. In a reinforced soil application, however, the use of metallic parts should be avoided as much as possible since they can give rise to corrosion. When the anchoring core is made of concrete, its cross-section must be larger so that it can withstand the high tensile loads applied by the reinforcements, and removable inserts as disclosed in these two documents cannot be used.

U.S. Pat. No. 5,839,855 A and EP 2 850 251 B1 disclose using a void former including two halves made of rigid material, that are joined together when the facing element is cast, and then disconnected, rotated and removed once the concrete has hardened. The void former forms a channel around a concrete core cast together with the facing element. Each half has a varying cross-section to gradually enlarge the cross-section of the channel towards the rear side of the facing element, so as to allow removal of the void former once the concrete has hardened. A disadvantage of such a casting assembly is that it may create split lines or other surface defects on the anchoring core at the junction between the two halves of the void former. Such defects give rise to friction that can damage the reinforcements over time. The manufacture of the facing element according to EP 2 850 251 B1 can remain expensive since mounting and unmounting of the casting assemblies requires several steps to connect/disconnect both parts and remove them from the channels.

There exists a need to provide a simpler, more reliable solution to manufacture anchoring elements in facing elements used in reinforced soil structures.

SUMMARY

A method of manufacturing a facing element for a reinforced soil structure is disclosed. The method comprises:

- arranging a void former in a mold, the void former including at least one insert made of flexible material, wherein the at least one insert forms a loop around a core region within the mold;
- adding casting material in a fluid state into the mold such that the casting material fills a predefined volume for the facing element including the core region;
- letting the casting material harden to form the facing element; and
- removing the facing element from the mold and the void former from the facing element.

The facing element comprises an anchoring core formed by the hardened casting material in the core region. Removing the void former comprises pulling the at least one insert away from a rear surface of the facing element, the flexible material of the at least one insert being deformed around the anchoring core while it is pulled.

The shape of the channel that will receive reinforcement members of the reinforced soil structure is defined by a flexible insert that molds the anchoring core, and can be easily removed to be, if necessary, reused to make another facing element. The flexible insert is simply pulled and deformed, in the manner of a belt while the void former is removed.

The anchoring core may have a load-transfer surface arranged to be in contact with a loop section of a reinforcement member of the reinforced soil structure such that, on both sides of the loop section, the reinforcement member is not in contact with the anchoring core and includes two respective tensioned sections protruding from the rear surface of the facing element. Advantageously, in such configuration, a single insert of the void former, made of flexible material, may extend continuously along the load-transfer surface of the anchoring core when the casting material is added and hardened.

In an embodiment, the facing element has a channel around the anchoring core, shaped by the void former and opened on the rear surface of the facing element, and a portion of the channel located on a front side of the anchoring core has a constant cross-section. The portion of the channel that has a constant cross-section may extend over more than half of a length of the channel.

Alternatively, the at least one insert of the void former has a first end portion, a second end portion opposite the first end portion and a thickness that decreases from the first end portion to the second end portion. The at least one insert is pulled away from the rear surface of the facing element via the first end portion.

In an embodiment, the at least one insert of the void former has internal armatures.

In an embodiment, a tubular member is disposed in the mold around the core region, the tubular member being surrounded by the loop formed by the at least one insert. The void former may further include a support structure to hold the tubular member and the at least one insert in place within the mold. The at least one insert of the void former may comprise at least one flexible strip maintained between the tubular member and an inner surface of the support structure.

In an embodiment, the at least one insert made of flexible material is hollow, arranging the void former in the mold comprises injecting a fluid medium under pressure into the at least one insert, and removing the void former comprises releasing the pressure in the at least one insert of the void former.

In an embodiment, an insert of the void former, made of flexible material, has an end provided with a first connector part, a second connector part cooperates with the first connector part to maintain the insert in position in the mold around the core region when the casting material is added and hardened, and removing the void former comprises separating the first and second connector parts from each other.

When the void former includes one insert made of flexible material, the insert may have first and second end portions and a thickness that decreases from the first end portion to the second end portion. Arranging the void former in the mold may then comprise disposing both the first and second end portions of the insert adjacent to a surface of the mold that matches the rear surface of the facing element to form the loop around the core region. Removing the void former is then facilitated by pulling the insert) away from a rear surface via the first end portion thereof.

In an embodiment of the method, the at least one insert of the void former includes a plurality of superimposed layers of flexible material. The facing element having a channel around the anchoring core, shaped by the void former and having first and second openings on a rear surface of the facing element, the plurality of superimposed layers of flexible material may include at least one layer pulled through the first opening of the channel when the void former is removed and at least one layer pulled through the second opening of the channel when the void former is removed. A layer of flexible material pulled through the first opening may have a thickness decreasing from the first opening towards a distal end thereof while a layer of flexible material pulled through the second opening has a thickness decreasing from the second opening towards a distal end thereof, such that at least part of the channel has a constant cross-section.

Other features and advantages of the method and apparatus disclosed herein will become apparent from the following description of non-limiting embodiments, with reference to the appended drawings.

BRIEF DESCRIPTION OF THE DRAWINGS

FIGS. 4-6 are schematic sectional views of other examples of flexible inserts;

For clarity, the dimensions of features represented on these figures may not necessarily correspond to the real-size proportions of the corresponding elements. Like reference numerals on the figures correspond to similar elements or items.

DESCRIPTION OF EMBODIMENTS

The invention addresses issues arising during manufacturing of facing elements intended to be used in reinforced soil structures. More particularly, the invention provides a simple, convenient and cost efficient way of creating anchorages at the rear side of facing elements, by using reusable inserts.

Figure 1:
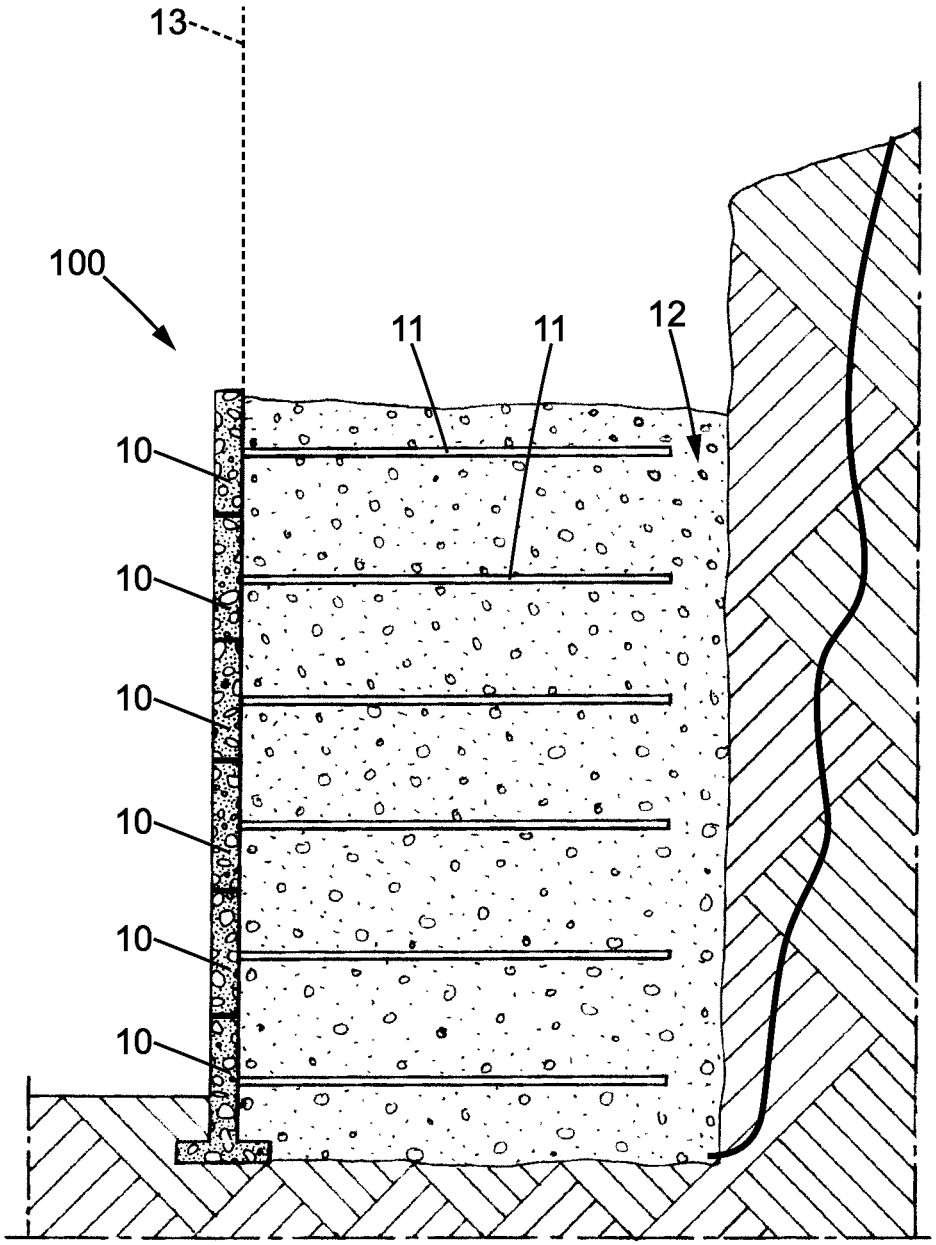
FIG. 1 is a schematic sectional view of a reinforced soil structure comprising facing elements with reinforcements connected to the facing elements.

FIG. 1 is a schematic sectional view of a reinforced soil structure 100. The structure comprises a front face made of facing elements 10 which may be arranged to form a wall. Backfill 12 is arranged behind the facing elements 10. A secure connection between the facing elements 10 and the backfill 12 is ensured with the use of reinforcements 11 anchored to the rear surface 13 of the facing elements and extending into the backfill 12.

The reinforcements 11 are typically in the form of strips of synthetic material. In an example, the reinforcement strips 11 are based on polyester fibers embedded in a flexible polyethylene matrix. Other kinds of reinforcements can be used, such as geotextile grids, webs or strips.

Figure 2:
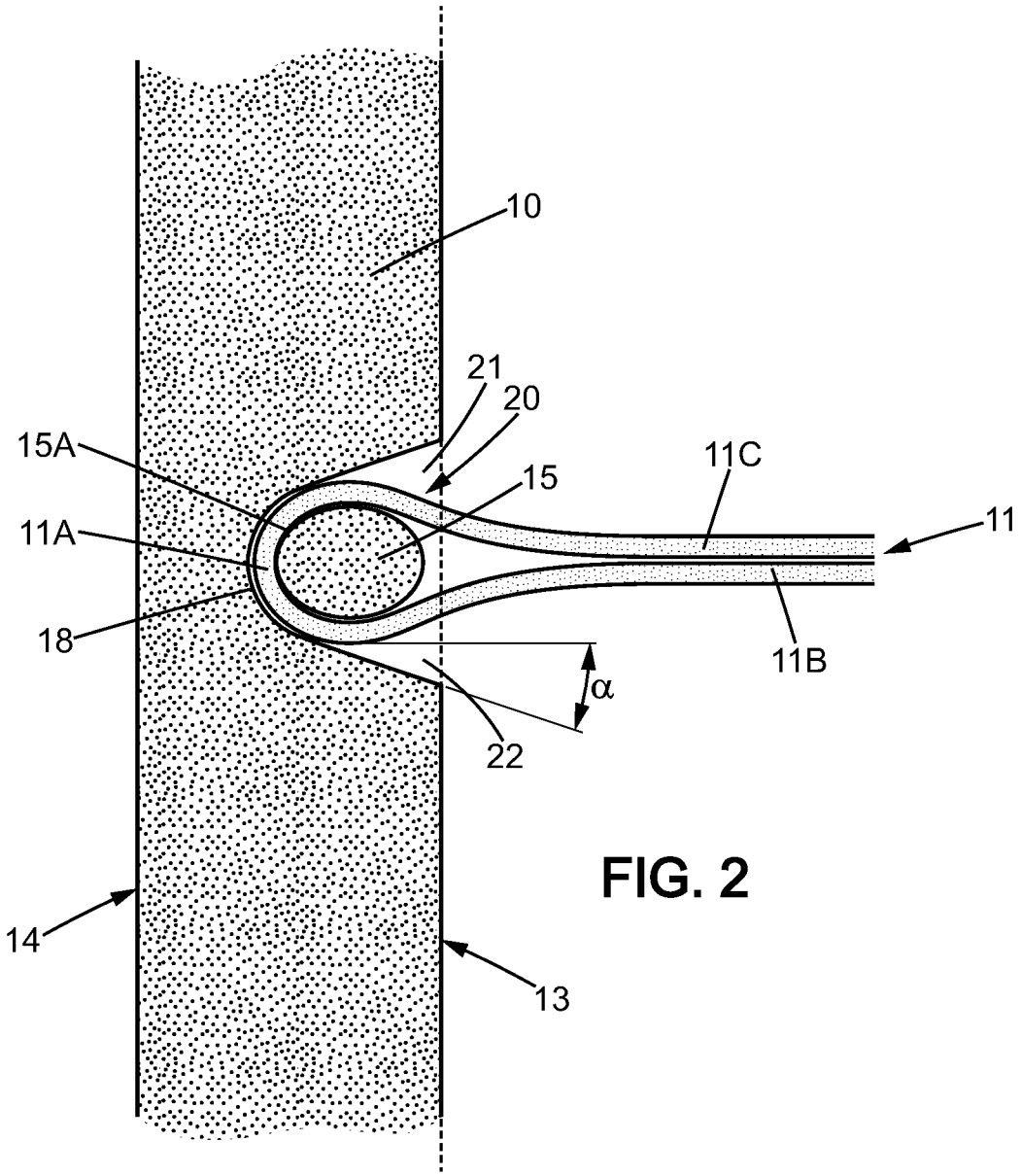
FIG. 2 is a schematic sectional view of a facing element and an anchoring core thereof.

As illustrated in FIG. 2, anchoring of a reinforcements strip 11 is done by means of a generally C-shaped channel 20 formed in the concrete body of the facing element 10 around an anchoring core 15. The channel 20 is located between the rear surface 13 and the front surface 14 of the concrete body. It opens on the rear surface 13 at first and second openings 21, 22. Between the first and second openings 21, 22, a portion 18 of the channel 20 located on the front side of the anchoring core 15 is a loop portion where the reinforcement strip 11 forms a loop.

In the loop portion 18 of the channel 20, the anchoring core 15 has a load-transfer surface 15A in contact with a loop section 11A of a reinforcement strip 11 of the reinforced soil structure. On both sides of the loop section 11A, the reinforcement strip 11 is normally not in contact with the anchoring core 15, and it includes two tensioned sections 11B, 11C that protrude from the rear surface 13 of the facing element 10 to extend into the backfill 12. Tension is applied to the sections 11B, 11C due to the load of the backfill. It translates into a compressive force applied to the loop section 11A that transfers the load to the anchoring core 15.

The anchoring core 15 must be sturdy to take the transferred load. When the anchoring core 15 is made of concrete, its cross-section must be substantial, while it is also desired that the overall thickness of the concrete facing element 10 does not become exceedingly high. Therefore, some optimization of the geometry of the channel 20 should take place, keeping in mind the manufacturing constraints.

In the embodiment shown in FIG. 2, the loop portion 18 of the channel 20 has a constant cross-section. The manufacturing process of the facing element, described in more detail below, does not require that the cross-section the loop portion 18 be widened towards the openings 21, 22 (though such widening is also a possibility). For example, the constant cross-section is selected to be slightly thicker than a reinforcement strip 11 to allow its insertion into the channel 11. But it can remain relatively thin, which is advantageous to provide a robust anchorage. In particular, the manufacturing process is not a reason any more to widen the channel.

A facing element is manufactured by pouring casting material, typically concrete, in a mold that gives the facing element its shape. After hardening of the casting material, the facing element 10 can be removed from its mold.

To create a channel 20 and an anchoring core 15, a void former is used, such as one of those illustrated in FIGS. 3-16. Preferably, the void former is a reusable casting element, i.e. once it has been used to make a facing element 10, it can be retrieved to be used again to make another similar facing element 10.

Figure 3A:
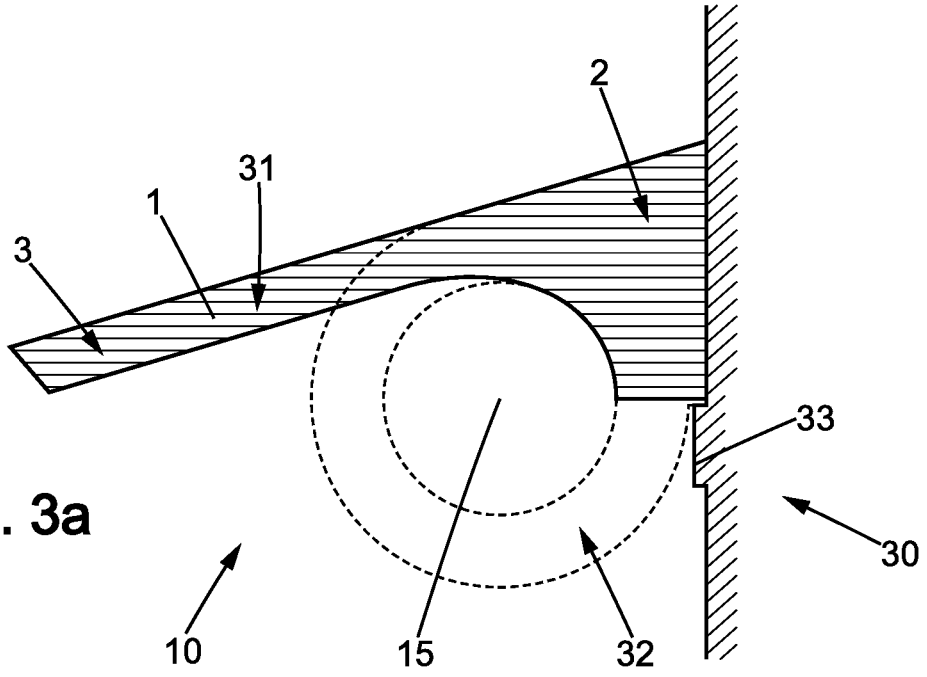
FIGS. 3*a* and 3*b* are schematic sectional and perspective views of a flexible insert usable in an embodiment of the invention.
Figure 3B:
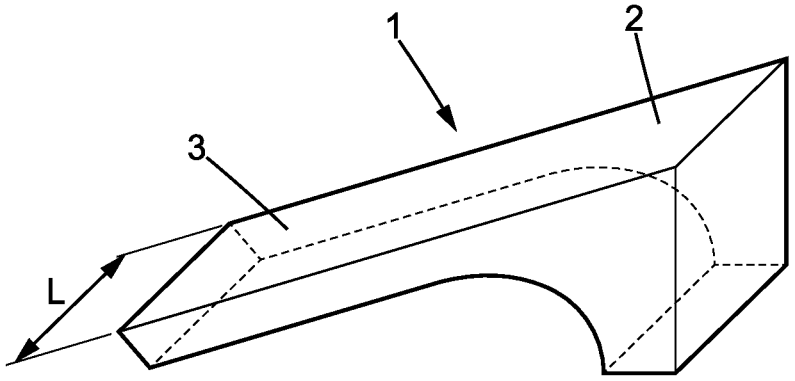

As shown in FIGS. 3*a* and 3*b*, the void former can be in the form of an insert 1 of flexible material made up of only one piece having a first end portion 2 and a second end portion 3. The width L of the insert 1 is slightly larger than that of a reinforcement strip 11. The insert is disposed in the mold so as to form a loop around a core region that corresponds the intended shape of the anchoring core 15.

In a first, unstrained state, the flexible insert 1 has a first shape 31, shown in perspective in FIG. 3*b*, in which the end portions 2, 3 are spaced apart from each other. The cross-section of the flexible insert 1 at the first end portion 2 is larger than at the second end portion 3. This enables the first end portion 2 to give a suitable shape to the first opening 21 of the channel 20 to be formed in the facing element 10, e.g. with a suitable opening angle $\alpha$ (FIG. 2). A larger cross-section at the end portion 2 also provides a gripping part that can facilitate extraction of the void former once the facing element 10 is cast. After the facing element is cast, the void former is extracted by pulling it out of the channel 20, for example by exerting a pulling force on the gripping part provided by the end portion 2.

In other embodiments (not shown), the cross-section of the first end portion 2 of the flexible insert 1 is similar to that of the second end portion 3. In that case, a support structure can be attached to the first end portion 2 to provide a suitable shape of the first opening 21, in particular with a sufficient opening angle $\alpha$.

As shown in FIG. 3*a*, the flexible insert can be bent into a second shape 32, in which the second end portion 3 is brought closer to the first end portion 2 than in the first shape 31. In this second shape 32, the flexible insert 1 is maintained in a strained state and occupies a volume matching that of the channel 20 of the cast facing element 10. The flexible insert 1 is placed in the mold 30 in this bent state for forming the channel 20.

The flexible insert 1 shown in FIGS. 3*a* and 3*b* has a constant thickness on most of its length, at least when it is bent into its second shape 32. It is therefore suitable to form a loop portion 18 of the channel as discussed above.

To force the reusable casting element 1 into the second shape 32, the mold 30 may comprise structures 33 on which the flexible insert 1 can be attached or with which it can be blocked in the second shape 32.

The change from the first shape 31 to the second shape 32 or vice-versa implies a larger deformation of the flexible insert 1 at the second portion 3 than at the first portion 2. The polymer material of which the flexible insert 1 is made can take advantage of this fact and have a higher elasticity at the second end portion 3 than at the first end portion 2. For example, this elasticity may gradually increase from the first end portion 2 to the second end portion 3.

One example of a material suitable for the flexible insert 1 is polyurethane. This material is chemically resistant to concrete, capable of resilient deformation without being damaged in the process and is easy and cheap to produce. Other materials or mix of different materials can be used for the flexible insert 1.

In another embodiment, the unstrained shape of the flexible insert 1 can be that 32 shown in dashed lines in FIG. 3*a*, in which case the flexible insert 1 is only subjected to a resilient deformation when it is pulled out of the facing element 10 after hardening of the casting material in the mold.

FIG. 4 illustrates another embodiment of the void former in which the second end portion of the flexible insert 1 is provided with a first connector part 41 which enables a releasable lock contact with a second connector part 43, either on the first end portion (not shown) or on the mold 30, for example. The connector part 41 may for example be a threading adapted to receive a screw, a clip that cooperates with an element having a complementary shape, a magnetic connector, an adhesive connector, a zip, a recess that can be inserted into a protrusion or vice versa, etc.

Removing the void former of FIG. 4 from the facing element 10 after hardening of the concrete includes separating the pair of connector parts 41, 42 located at the second end portion 3 from each other, and pulling on the first end portion 2.

As can be seen in FIG. 4, a support structure 50 can be used to provide a sufficient opening angle $\alpha$ to the second opening 22 of the channel 20. The support structure 50 may for example be a protrusion in the mold 30 or another piece having a shape adapted to engage with the flexible insert 1 and force it into the shape 32 shown in FIG. 3*a*.

FIG. 5 shows that the first end portion 2 of the flexible insert 1 is not necessarily in contact with the second end portion 3 when the void former is arranged in the mold 30. In the embodiment of FIG. 5, a gap 45 remains between the two end portions 2, 3. The two end portions 2, 3 have respective connector parts 41 that can be joined by another connector part 44 such as a key or a C-shaped lock for example. Joining two connector parts 41 arranged on the end portions 2, 3 of the flexible insert can also be done when both end portions are in direct contact (like in the situation illustrated in FIG. 4).

FIG. 5 further illustrates the possibility of providing a sheath 40 around the flexible insert 1. Such sheath 40 can reduce friction between the flexible insert 1 and the concrete, when the flexible insert is extracted from the manufactured facing element 10. The sheath 40 can also provide a smooth surface for contact with the reinforcement strip 11.

According to another embodiment, the flexible insert 1 may itself be a hollow sheath or sleeve. To match the intended shape of the channel 20 and withstand the pressure of the concrete added in a fluid state into the mold 30, such hollow sheath or sleeve may be filled with material, such as for example sand, a gas (pressurized air, carbon dioxide for example), a liquid (for example oil or water) or concrete.

FIG. 6 shows another example of a flexible insert 1 in which both the first and second end portions 2, 3 of the flexible insert 1 comprise first connector parts 41. These connector parts 41 can be used to mount the flexible insert 1 in the mold 30, and to force it into the bent shape 32 by cooperating with corresponding second connector parts 43 on the mold 30.

Figure 7:
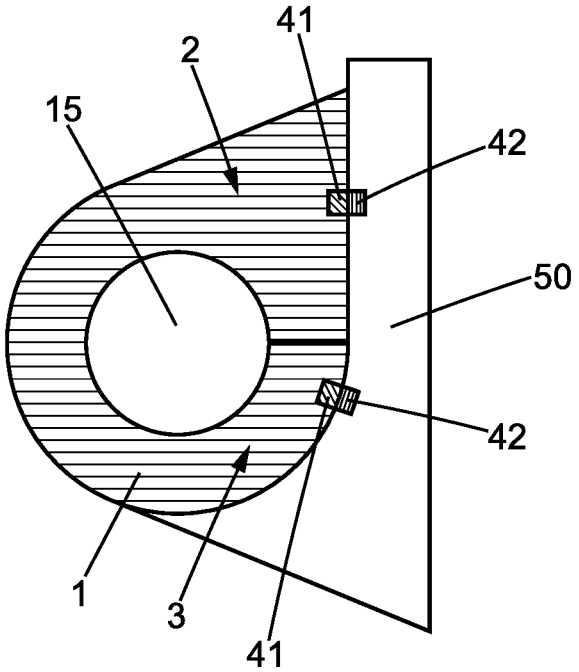
FIGS. 7-8 are schematic sectional views of void formers according to other embodiments of the invention.
Figure 8:
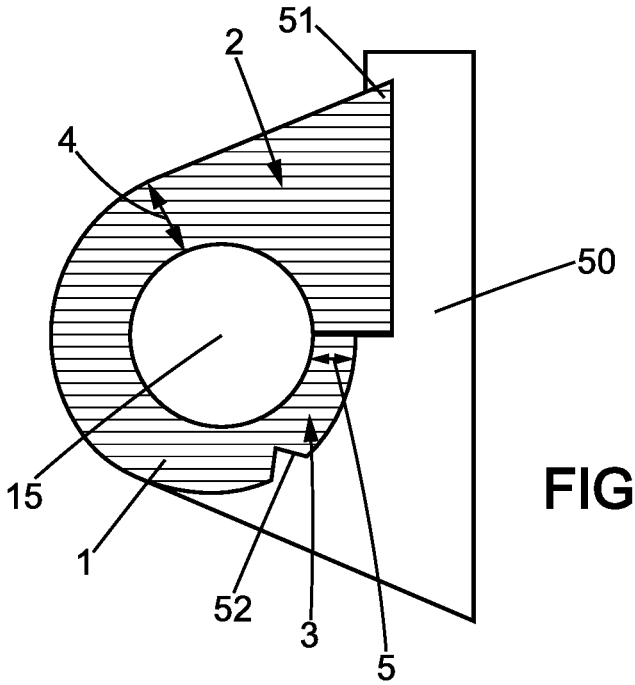

The above examples mostly rely on mounting the flexible insert 1 on the mold 30 used to form the facing element 10. However, the flexible insert 1 may also be used in combination with a support structure 50 that is mounted in the mold 30. FIGS. 7 and 8 show two examples of such void formers including a flexible insert 1 and a support structure 50.

FIG. 7 shows a flexible insert 1 similar to that of FIG. 6, attached to a support structure 50 via first connector parts 41 respectively disposed at its end portions 2, 3, which engage respective second connector parts 42 arranged in the support structure 50.

FIG. 8 shows an alternative embodiment where the support structure 50 comprises recesses 51 and protrusions 52 for cooperating with the flexible insert 1. In the configuration of FIG. 8, both the first and second end portions 2, 3 of the insert 1 are disposed adjacent to the surface of the mold 30 that matches the rear surface 13 of the facing element to form the loop around the core region.

The embodiment of FIG. 8 includes another feature, which is also usable in other embodiments, whereby the thickness of the flexible insert 1 decreases near its second end portion 3. The thickness 4 at the first end portion 2 is larger than the thickness 5 at the second end portion 3. This decreasing thickness facilitates extraction of the flexible insert 1 once the facing element 10 is manufactured. The second end portion 3 of the flexible insert 1 is less subjected to friction when it is pulled out of the facing element.

Figure 9:
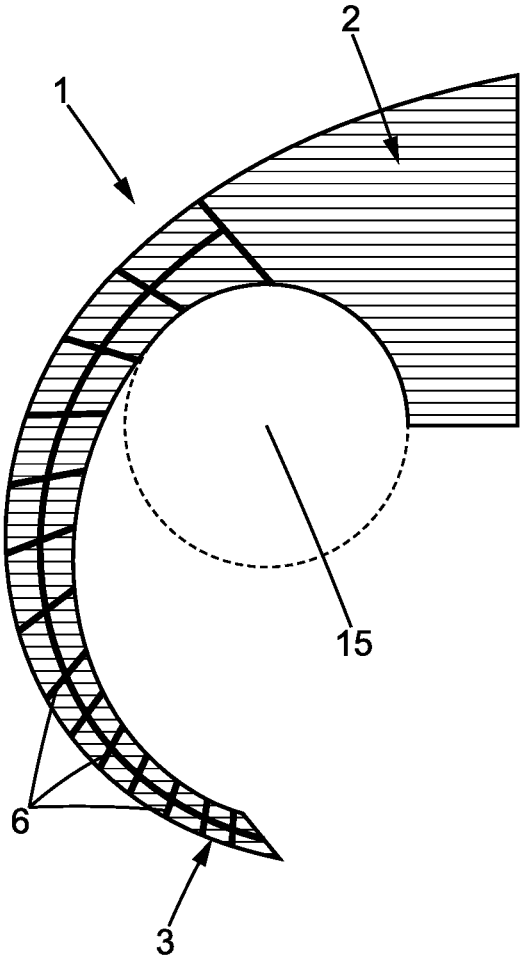
FIG. 9 is a schematic sectional view of another example of a flexible insert.

Further possible improvements to the void former are represented in FIG. 9. Here, the flexible insert 1 comprises internal armatures 6, such as embedded metal or carbon grids or strips, that extend the lifetime of the flexible insert 1. These armatures 6 add strength, preferably near the second end portion 3 of the flexible insert, to avoid inelastic deformation thereof. The inserts can be made of a composite material which improves resistance of the reusable casting element 1 to frictional forces or to tensile stress. The internal armatures 6 may also take the form of ribs.

Another feature illustrated in FIG. 9 relates to the curved shape of the flexible insert 1 in its unstrained state. The curved shape is such that a strain applied to the flexible insert 1 in its looped configuration in the mold 30 is smaller than a strain applied to the flexible insert 1 when it is pulled away from the facing element 10. Such a curved shape reduces the total deformation that the second end portion 3 undergoes when the flexible insert 1 is forced to adopt shape 31 or 32 illustrated in FIG. 3*a*. This reduces risks of surface defects such as split lines in the hollow curved portion 20, in particular around the anchoring core and the second opening 22.

Figure 10:
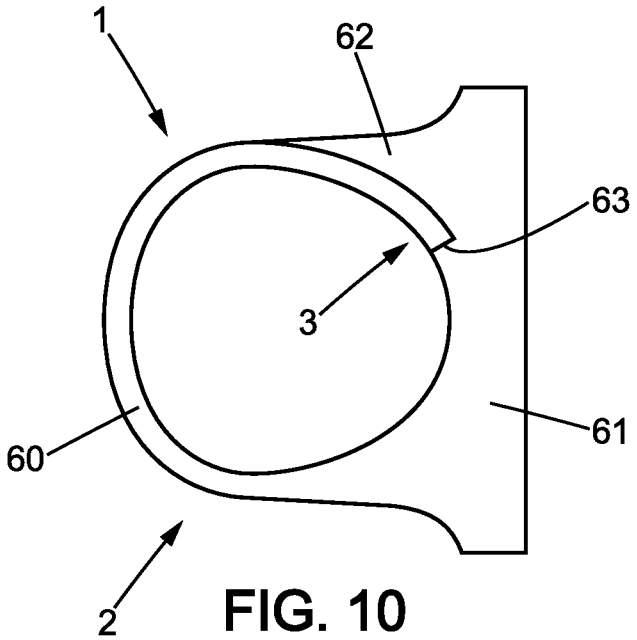
FIGS. 10-11 are schematic sectional and perspective views of a flexible insert usable in another embodiment of the invention.
Figure 11:
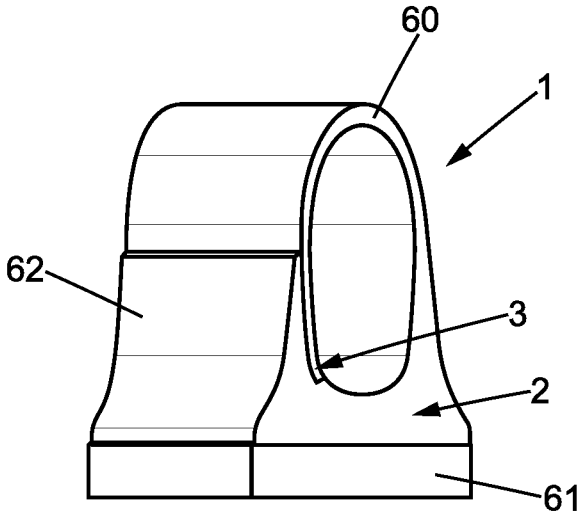

In the embodiment shown in FIGS. 10-11, the void former consists or a flexible insert 1 made of one piece of rubber of which one part 60 forms a strap of substantially constant thickness extending from the first end portion 2 to the second end portion 3, and another part 61 forms a base that is left out of the concrete when is it poured in the mold. When the strap 60 is bent in the position shown in FIGS. 10-11, the second end portion 3 has its outer surface bearing on a support structure 62 belonging to the base 61 and defining the shape of the channel its second end 22. The support structure 62 has a recess 63 that receives the tip of the strap 60 to keep it in position in the mold. After the concrete has hardened, the flexible insert 1 is pulled away from the facing element 10 by gripping it by the base 61.

Figure 12:
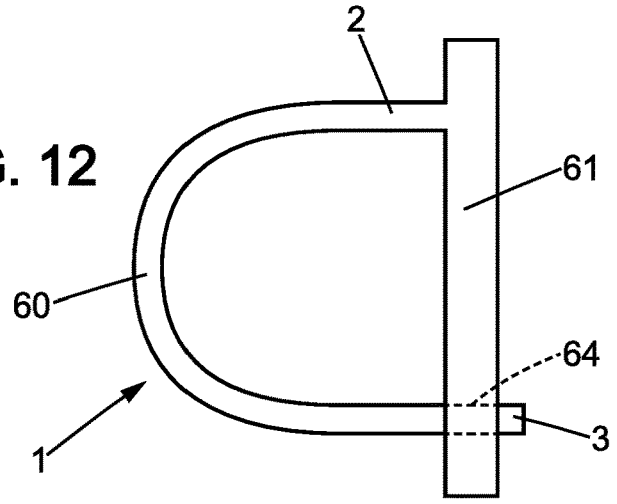
FIGS. 12-15 are schematic sectional views of alternative void formers.

The flexible insert 1 shown in FIG. 12 also has a base part 61 and a strap part 60 that forms the channel 20 in the facing element 10. The second end 3 of the strap 60 is received in a hole 64 formed in the base 61 in order to be kept in position in the mold. The flexible insert 1 is removed from the facing element 10 by pulling on the base 61. At that time, the strap 60 unfolds by being deformed along the channel 20 formed in the concrete material of the facing element 10.

Figure 13:
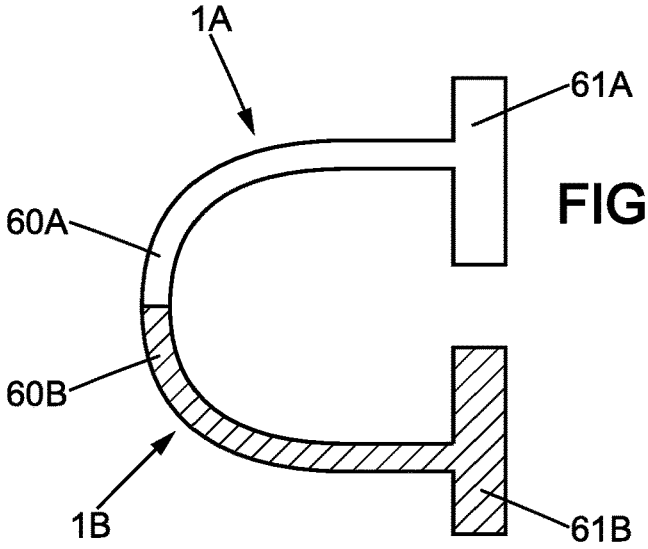

In the alternative embodiment shown in FIG. 13, the void former includes two flexible inserts 1A, 1B each having a base part 61A, 61B and a strap part 60A, 60B. The two strap parts 60A, 60B have their distal end surfaces in contact with each other when the void former is positioned in the mold. The contact is in the portion 18 of the channel 20 located on the front side of the anchoring core 15. The distal end surfaces of the two strap parts 60A, 60B may have matched shapes (e.g. pin/hole, tenon/mortise, etc.), and they are releasably connected to each other so as to define a smooth shape for the channel 20 while making it possible to pull the flexible inserts 1A, 1B away via their base part 61A, 61B.

Figure 14:
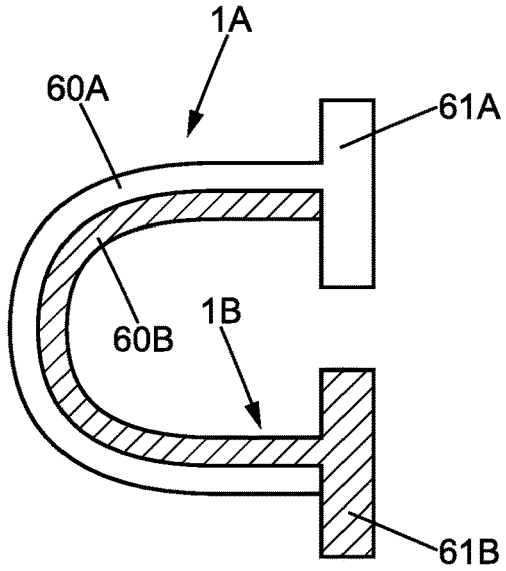

Another possible arrangement of the void former is shown in FIG. 14. Here, the void former also includes two flexible inserts 1A, 1B each having a base part 61A, 61B and a strap part 60A, 60B. The two strap parts 60A, 60B form superimposed layers of flexible material to define the shape of the channel 20. The strap part 60A of the flexible insert 1A has an outer surface which defines the external shape of the channel 20, and an inner surface which is in contact with the outer surface of the other strap part 60B when the void former is positioned in the mold, i.e. in the position shown in FIG. 14. The strap part 60B of the flexible insert 1B has an inner surface which defines the internal shape of the channel 20 (or the load-transfer surface 15A of the anchoring core 15). The strap parts 60A, 60B are dimensioned such that the distal end of the strap part 60A/60B of each flexible insert 1A/1B abuts the base 61B/61A of the other flexible insert 1B/1A, thus defining the predefined shapes of the channel 20 and of the anchoring core 15.

Each of the strap parts 60A, 60B of the void former shown in FIG. 14 may have a thickness that decreases from the base part 61A, 61B to its distal end, in order to facilitate its extraction from the hardened facing element 10. If the rate of decrease of the thickness of the strap parts 60A, 60B is the same for both flexible inserts 1A, 1B, the advantage of facilitating extraction can be obtained as well as the advantage of having a constant cross-section in the portion 18 of the channel 20 located on a front side of the anchoring core 15.

Removing the void former of FIG. 14 includes pulling the strap part 60A via the first opening 21 by gripping the base part 61A, and pulling the strap part 60B via the second opening 22 by gripping the base part 61B, one after the other or simultaneously.

Figure 15:
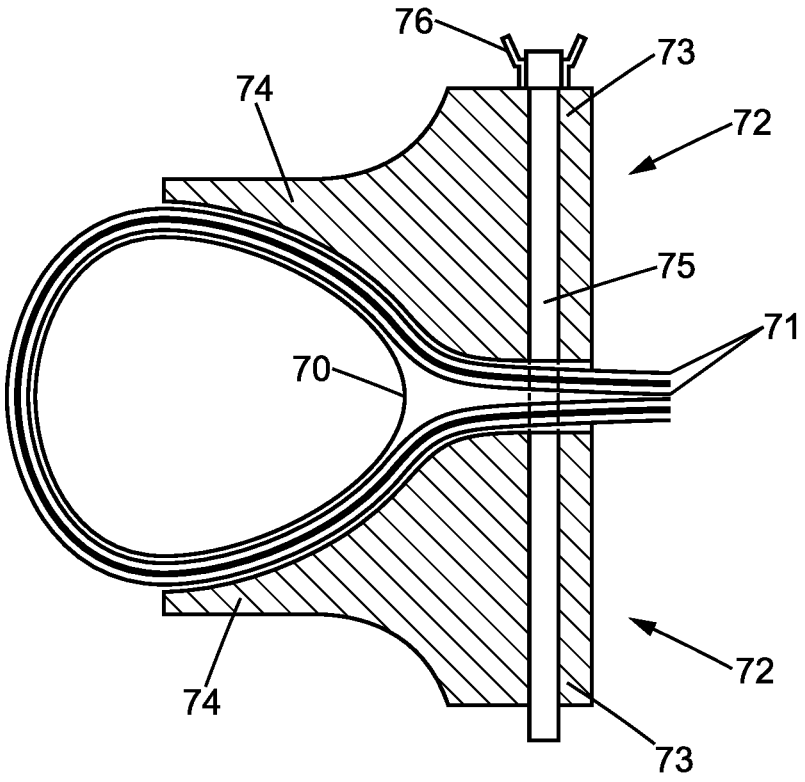

FIG. 15 shows another embodiment of the void former, that includes:

- a tubular member 70 whose internal shape matches the intended external shape of the anchoring core 15;

one or more flexible strips 71 arranged parallel to each other and forming a loop around the tubular member 70;

two jaws 72 forming a support structure for the void former.

Each jaw 72 has a base part 73 that remains outside of the concrete poured in the mold 30, and an extension part 74 that is immersed in the concrete. The two jaws 72 are placed on both sides of the loop formed by the flexible strips 71 around the tubular member 70. They clamp the flexible strips 71 by being pressed one towards the other using, for example, one or more screws 75 and nuts 76 disposed in the base parts 73. The extension parts 74 of the jaws 72 provide support structures (similar to the support structures 50 described with reference to FIGS. 6-8) to keep the flexible strips 71 in position while defining the shape of the end portions 21, 22 of the channel 20.

Removal of the void former illustrated in FIG. 15 after hardening of the concrete includes releasing the screws/nuts 75/76, taking out the jaws 72 by pulling them via their base parts 73 and pulling an end of the flexible strip(s) 71 to clear the channel 20.

The tubular member 70 remains in the concrete of the facing element 10. It is preferably made of plastic material. It provides a smooth load-transfer surface 15A for the anchoring core 15. It will be noted that the tubular member 70 could cover only part of the periphery of the anchoring core 15, including the load-transfer surface 15A. It may be open to word the rear side of the facing element 10.

Figure 16A:
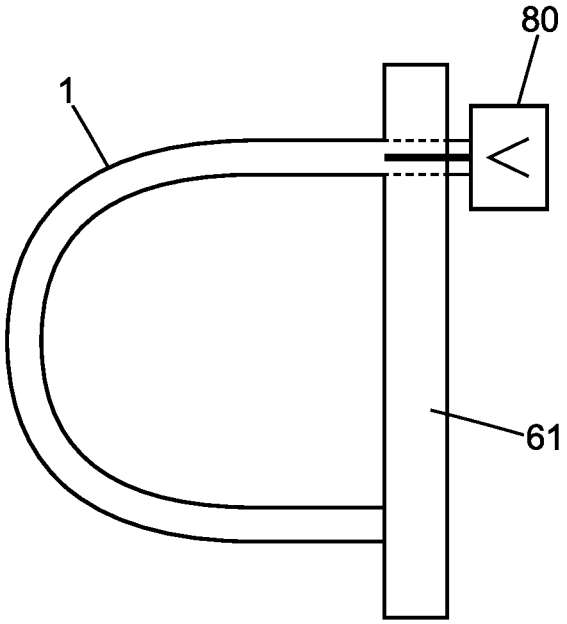
FIGS. 16*a* and 16*b* are schematic views of another example of void former in accordance with an embodiment of the invention.
Figure 16B:
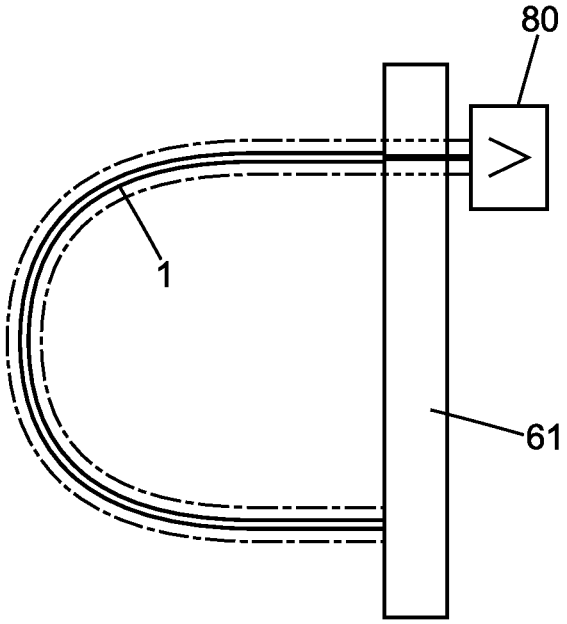

In the embodiment shown in FIGS. 16*a-b*, the void former has a rigid base 61 and an insert 1 which is hollow and made of a flexible material, so as to be inflatable. In this example, the flexible insert 1 has its two ends connected to the base 61, for example one end permanently attached to the base 61 and another end passing through the base 61 to be put in communication with a source of fluid medium via a pump 80. In the configuration shown in FIG. 16A, the fluid medium (e.g. water, oil, air or some other gas) is injected into the hollow flexible insert 1 which then takes the shape intended for the channel 20 in the facing element 10. The concrete material can then be poured and hardened. Afterwards, the fluid medium is evacuated from the hollow flexible insert 1, the end of the hollow flexible insert 1 is disconnected from the pump 80 and the void former can then be removed from the facing element by pulling on the base 61 while the insert 1 is deformed along the channel 20.

The examples described above in connection with FIGS. 3-16 comprise features that can be easily combined with each other.

In the embodiments of FIGS. 3-12 and 14-16, a single insert of the void former, made of flexible material, extends continuously along the load-transfer surface 15A of the anchoring core when the casting material is added and hardened. This ensures a smooth load-transfer surface 15A, which is favorable to durability of the reinforced soil structure 100 by avoiding surface defects at the places where the tensioned reinforcement strips 11 are in contact with the facing.

It will be appreciated that the embodiments described above are illustrative of the invention disclosed herein and that various modifications can be made without departing from the scope as defined in the appended claims.

The invention claimed is:

1. A method of manufacturing a facing element for a reinforced soil structure, the method comprising:

arranging a void former in a mold, the void former including at least one insert made of flexible material, wherein the at least one insert forms a loop around a core region within the mold;

adding casting material in a fluid state into the mold such that the casting material fills a predefined volume for the facing element, the predefined volume including the core region;

letting the casting material harden to form the facing element; and removing the facing element from the mold and the void former from the facing element, wherein the facing element comprises an anchoring core formed by the hardened casting material in the core region, and wherein removing the void former comprises pulling the at least one insert away from a rear surface of the facing element, the flexible material of the at least one insert being deformed around the anchoring core while it is pulled.

2. The method as claimed in claim 1, wherein the anchoring core has a load-transfer surface arranged to be in contact with a loop section of a reinforcement member of the reinforced soil structure such that, on both sides of the loop section, the reinforcement member is not in contact with the anchoring core and includes two respective tensioned sections protruding from the rear surface of the facing element, and wherein a single insert of the void former, made of flexible material, extends continuously along the load-transfer surface of the anchoring core when the casting material is added and hardened.

3. The method as claimed in claim 1, wherein the facing element has a channel around the anchoring core, shaped by the void former and opened on the rear surface of the facing element, and wherein a portion of the channel located on a front side of the anchoring core has a constant cross-section.

4. The method as claimed in claim 3, wherein the portion of the channel that has a constant cross-section extends over more than half of a length of the channel.

5. The method as claimed in claim 1, wherein the at least one insert of the void former has a first end portion a second end portion opposite the first end portion and a thickness that decreases from the first end portion to the second end portion, and wherein the at least one insert is pulled away from the rear surface of the facing element via the first end portion.

6. The method as claimed in claim 1, wherein the at least one insert of the void former has internal armatures.

7. The method as claimed in claim 1, wherein a tubular member is disposed in the mold around the core region, the tubular member being surrounded by the loop formed by the at least one insert.

8. The method as claimed in claim 7, wherein the void former further includes a support structure to hold the tubular member and the at least one insert in place within the mold.

9. The method as claimed in claim 8, wherein the at least one insert of the void former comprises at least one flexible strip maintained between the tubular member and an inner surface of the support structure.

10. The method as claimed in claim 1, wherein the at least one insert made of flexible material is hollow, wherein arranging the void former in the mold comprises injecting a fluid medium under pressure into the at least one insert, and wherein removing the void former comprises releasing the pressure in the at least one insert of the void former.

11. The method as claimed in claim 1, wherein an insert of the void former, made of flexible material, has an end portion provided with a first connector part, wherein a second connector part cooperates with the first connector part to maintain the insert in position in the mold around the core region when the casting material is added and hardened, and wherein removing the void former comprises separating the first and second connector parts from each other.

12. The method as claimed in claim 1, wherein the void former includes one insert made of flexible material having first and second end portions and a thickness that decreases from the first end portion to the second end portion, wherein arranging the void former in the mold comprises disposing both the first and second end portions of the insert adjacent to a surface of the mold that matches the rear surface of the facing element to form the loop around the core region, and wherein removing the void former comprises pulling the insert away from a rear surface via the first end portion thereof.

13. The method as claimed in claim 1, wherein the at least one insert of the void former includes a plurality of superimposed layers of flexible material.

14. The method as claimed in claim 13, wherein the facing element has a channel around the anchoring core shaped by the void former and having first and second openings on a rear surface of the facing element, and wherein the plurality of superimposed layers of flexible material include at least one layer pulled through the first opening of the channel when the void former is removed and at least one layer pulled through the second opening of the channel when the void former is removed.

15. The method as claimed in claim 14, wherein a layer of flexible material pulled through the first opening has a thickness decreasing from the first opening towards a distal end thereof while a layer of flexible material pulled through the second opening has a thickness decreasing from the second opening towards a distal end thereof, such that at least part of the channel has a constant cross-section.

* * * * *